United States Patent [19]

Lampredi et al.

[11] 4,279,226

[45] Jul. 21, 1981

[54] HYDRAULIC TAPPET FOR AN INTERNAL COMBUSTION ENGINE HAVING AN OVERHEAD CAMSHAFT

[75] Inventors: Aurelio Lampredi; Aldo Leoni; Luigi Ioli, all of Turin, Italy

[73] Assignee: Fiat Auto S.p.A., Turin, Italy

[21] Appl. No.: 66,142

[22] Filed: Aug. 13, 1979

[30] Foreign Application Priority Data

Nov. 15, 1978 [IT] Italy ..... 53889/78[U]

[51] Int. Cl.[3] ..... F01L 1/14; F01L 1/24

[52] U.S. Cl. ..... 123/90.55; 123/90.56; 123/90.48

[58] Field of Search ..... 123/90.1, 90.12, 90.13, 123/90.27, 90.48, 90.55, 90.56, 90.57, 90.58

[56] References Cited

U.S. PATENT DOCUMENTS

| | | | |
|---|---|---|---|
| 3,658,038 | 4/1972 | Bergmann | 123/90.55 |
| 3,670,707 | 6/1972 | Guido | 123/90.57 |
| 3,728,990 | 4/1973 | Lampredi et al. | 123/90.56 |

FOREIGN PATENT DOCUMENTS

| | | | |
|---|---|---|---|
| 1251366 | 12/1960 | France | 123/90.56 |
| 1241634 | 8/1971 | United Kingdom | 123/90.55 |

*Primary Examiner*—Charles J. Myhre
*Assistant Examiner*—W. Wolfe
*Attorney, Agent, or Firm*—Sughrue, Rothwell, Mion, Zinn and Macpeak

[57] ABSTRACT

An automatic hydraulic tappet for taking up clearance between a cam and a valve stem in an internal combustion engine with an overhead camshaft can rapidly attain its optimum operational efficiency when the engine is started, since the supply conduit, which supplies engine lubricating oil to an annular groove communicating with a chamber between two tappet members, is provided with a sump which is lower than the groove and, therefore, acts as an oil reservoir when the engine is stopped.

1 Claim, 2 Drawing Figures

HYDRAULIC TAPPET FOR AN INTERNAL COMBUSTION ENGINE HAVING AN OVERHEAD CAMSHAFT

The present invention relates to hydraulic tappets for internal combustion engines having overhead camshafts.

The invention is particulary concerned with a hydraulic tappet of the type which automatically takes up clearance between a cam and a valve stem and is supplied with oil from the lubrication circuit of the engine by means of a supply conduit which opens into annular manifold means communicating with the interior of the tappet through a plurality of radial ports.

The object of the present invention is to provide a hydraulic tappet of the aforesaid type which is brought more rapidly to its optimum operational efficiency, when the engine is started, than known tappets of the aforesaid type.

According to the present invention there is provided a hydraulic tappet of the aforesaid type, characterised in that the supply conduit communicates, adjacent the tappet, with a sump which extends below the level of the manifold.

In a tappet according to the invention, the sump remains full of oil at the end of each engine operating period and, therefore, acts as a reservoir to accelerate the attainment of optimum operational efficiency of the tappet when the engine is started.

Figure 1:
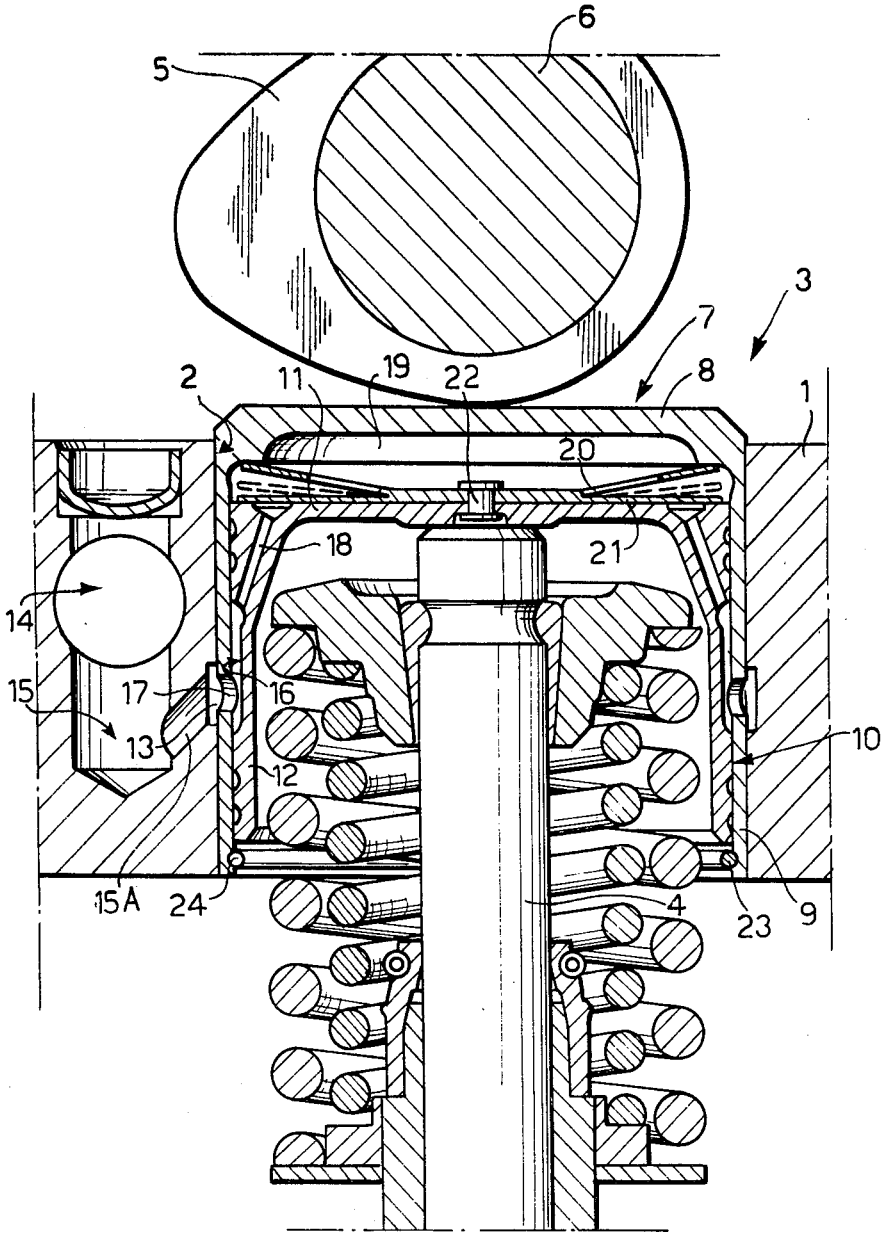
Figure 2:
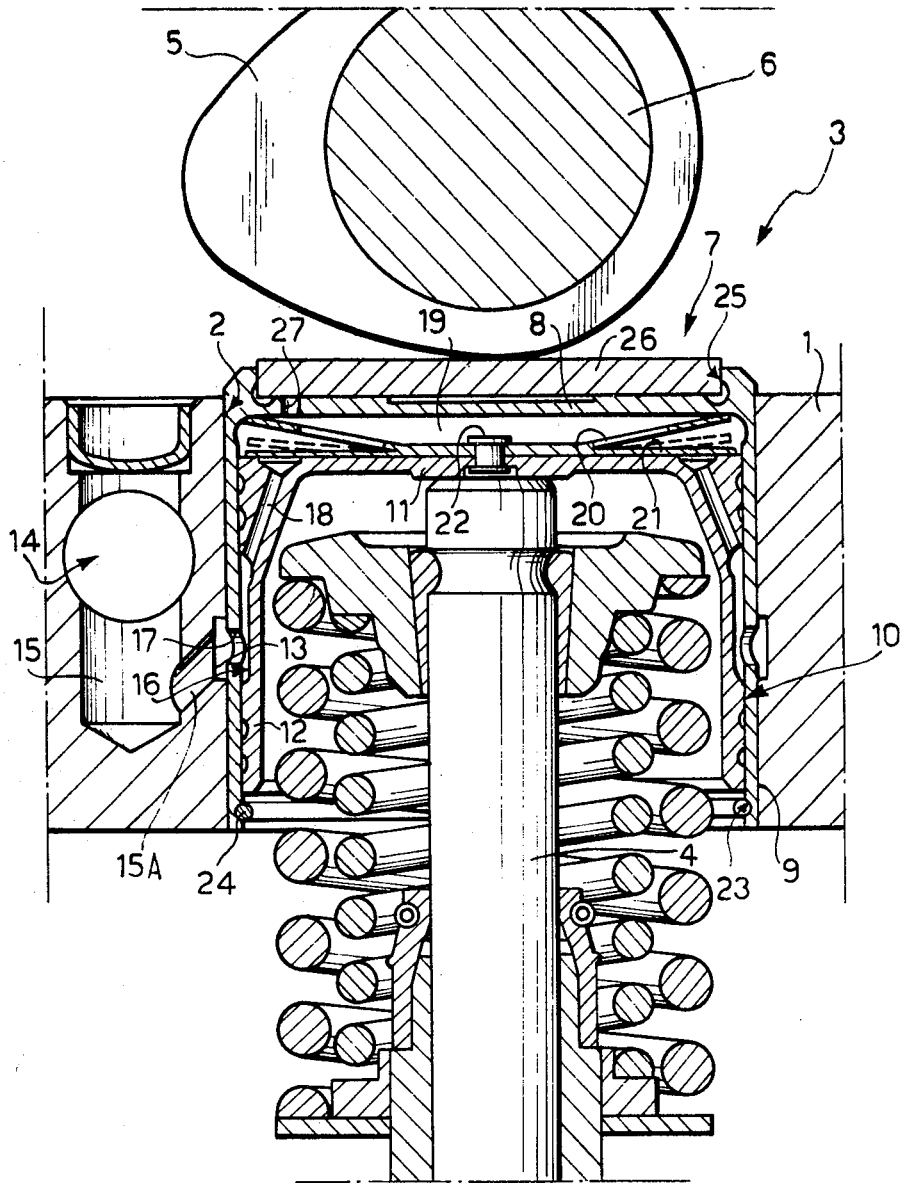

The invention will now be more particularly described, by way of example, with reference to the accompanying drawings, in which:

FIG. 1 is an axial section of an automatic clearance-compensating hydraulic tappet according to one embodiment of the present invention, and FIG. 2 is an axial section of a variant of the tappet shown in FIG. 1.

Referring now to FIG. 1, there is shown a portion 1 of the cylinder head of an internal combustion engine. The cylinder head portion 1 has a cylindrical seating 2 in which a hydraulic tappet, generally indicated 3, is slidably housed. The tappet 3 is interposed between the stem 4 of a valve (not shown) and a respective cam 5 of an overhead camshaft 6.

It will be appreciated, of course, that each cylinder of the engine has a respective tappet 3 and its associated components.

The tappet 3 includes a first inverted cup-shaped member 7, which is axially slidable within the seating 2, and comprises an end wall 8 which, in use, abuts the cam 5, and a dependent cylindrical skirt 9. A second inverted cup-shaped member 10 is axially slidable within the first member 7 and comprises an end wall 11, which rests upon the adjacent end of the valve stem 4, and a depending cylindrical skirt 12.

An annular manifold, comprising a groove 13, is made in the wall of the seating 2 and is supplied with oil from the engine lubrication circuit by a supply conduit 14 formed in the cylinder head 1. Adjacent the groove 13 the supply conduit 14 communicates with a sump 15 which, extending below the level of the groove 13, is in communication with the latter through a duct 15A which is inclined downwardly towards the base of the sump 15.

An annular channel 16 is formed on the outer face of the skirt 12 of the second tappet member 10, the channel 16 communicating, through a plurality of substantially axial passages 18, with a chamber 19 which is defined between the respective end walls 8, 11 of the tappet members 7, 10. The annular groove 13 and the channel 16 communicate through a plurality of radial ports 17 made in the skirt 9 of the first tappet member 7.

The chamber 19 houses a cup spring 20 which urges the tappet members 7, 10 apart. A centrally anchored flexible disc 21, interposed between the cup spring 20 and the end wall 11 of the second tappet member 10, acts as a non-return valve to control the flow of oil from the passages 18 into the chamber 19. The cup spring 20 and the disc 21 are fixed by a central rivet 22 to the end wall 11 of the second member 10.

The illustrated hydraulic tappet operates as follows. After each period of engine operation oil will drain from the chamber 19 into the adjacent sump 15, which therefore acts as a reservoir, reducing the time taken for the tappet 3 to reach its optimum operation efficiency when the engine is restarted.

A resilient ring 24, which is housed in an annular groove 23 formed adjacent the free edge of the inner face of the skirt 9 of the first tappet member 7, acts as a stop to prevent the disengagement of the tappet members 7, 10 during use.

The rivetting of the cup spring 20 and the disc 21 to the end wall 11 is a simple means of ensuring that these parts are securely mounted relative to each other.

The variant shown in FIG. 2 differs from the tappet previously described only in that a shallow cylindrical seating 25, formed on the outer surface of the end wall 8 of the first tappet member 7, houses a cylindrical pad 26 which, in use, is in abutment with the cam 5, the pad 26 being of a suitable wearresistant material. An axial hole 27 is made through the end wall 8 so as to permit the expulsion of air and foam from the chamber 19 when the tappet begins its operation, thereby accelerating and facilitating the filling of the chamber 19 with oil upon starting of the engine.

We claim:

1. An internal combustion engine of the type having: a cylinder head; a lubrication circuit; an overhead camshaft, and a valve having a stem acted upon by a cam of said camshaft, a hydraulic tappet of the kind which automatically takes up clearance between said valve stem and said cam, including an oil supply conduit connected with said oil lubrication circuit; annular manifold means communicating with said supply conduit, and means defining a plurality of radial ports connecting said manifold means with the interior of said tappet, wherein the improvement comprises a sump which extends below the level of said manifold means and which communicates with said oil supply conduit adjacent said tappet, said tappet is axially slidable in a cylindrical seating formed in said cylinder head, said tappet includes a first inverted cup-shaped member which is axially slidable in said seating and defines said radial ports, and a second inverted cup-shaped member which is axially slidable in said first member and rests on said valve stem, said second member comprises an end wall, and a skirt dependent from said end wall, said tappet further includes a cup spring interposed between said end walls of said tappet members to urge said tappet members apart, and a flexible disc interposed between said cup spring and said end wall of said second member to act as a valve and to control the flow of oil, and said spring and said disc are rivetted centrally to said end wall of said second member.

* * * * *